US008197240B2

(12) United States Patent
Obara et al.

(10) Patent No.: US 8,197,240 B2
(45) Date of Patent: Jun. 12, 2012

(54) COMPRESSOR HAVING IMPROVED VALVE PLATE

(75) Inventors: Richard A. Obara, Huber Heights, OH (US); Brad A. Schulze, Minster, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 871 days.

(21) Appl. No.: 12/244,396

(22) Filed: Oct. 2, 2008

(65) Prior Publication Data

US 2009/0087329 A1 Apr. 2, 2009

Related U.S. Application Data

(60) Provisional application No. 60/976,873, filed on Oct. 2, 2007.

(51) Int. Cl.
*F04B 39/10* (2006.01)
*F04B 53/10* (2006.01)

(52) U.S. Cl. ..... 417/560; 417/559; 417/567; 417/571; 29/890.127; 29/527.5; 29/888; 29/888.02

(58) Field of Classification Search ..... 417/559, 417/571, 560, 567, 454; 29/890.127, 527.5, 29/33 C, 888, 888.02
See application file for complete search history.

(56) References Cited

U.S. PATENT DOCUMENTS

| | | | | |
|---|---|---|---|---|
| 2,449,408 | A | 9/1948 | Naab | |
| 4,470,774 | A * | 9/1984 | Chambers | 417/567 |
| 4,478,243 | A * | 10/1984 | King | 137/512.1 |
| 4,685,489 | A * | 8/1987 | Yun et al. | 137/543.15 |
| 4,811,757 | A | 3/1989 | Brandt | |
| 4,854,839 | A | 8/1989 | DiFlora | |
| 5,073,146 | A | 12/1991 | Beck | |
| 5,960,825 | A * | 10/1999 | Scancarello et al. | 137/543.19 |
| 6,016,833 | A * | 1/2000 | Spurny et al. | 137/512.1 |
| 6,116,874 | A * | 9/2000 | Nation et al. | 417/571 |
| 6,149,400 | A * | 11/2000 | Samland et al. | 417/298 |
| 6,254,357 | B1 * | 7/2001 | Lynn et al. | 417/269 |
| 6,382,927 | B1 * | 5/2002 | Sonobe et al. | 417/269 |
| 6,530,760 | B1 | 3/2003 | Graber et al. | |
| 6,767,195 | B2 | 7/2004 | Lee | |
| 7,040,877 | B2 * | 5/2006 | Bergman et al. | 417/567 |
| 7,214,040 | B2 | 5/2007 | Froeslev et al. | |
| 2004/0163713 | A1 * | 8/2004 | Schulze et al. | 137/512 |

(Continued)

FOREIGN PATENT DOCUMENTS

DE 941565 C 4/1956

(Continued)

OTHER PUBLICATIONS

International Preliminary Report on Patentability dated Apr. 7, 2010 regarding International Application No. PCT/US2008/011400.

(Continued)

*Primary Examiner* — Peter Macchiarolo
*Assistant Examiner* — Thomas A Hollweg
(74) *Attorney, Agent, or Firm* — Harness, Dickey & Pierce, P.L.C.

(57) ABSTRACT

A compressor may include a compressor body defining a compression cylinder, a compressor head coupled to the compressor body, and a valve plate assembly disposed between the compressor head and the compressor body. The valve plate assembly may include a first valve plate formed as a unitary casting and defining a suction chamber exposed to a suction pressure region of the compressor.

13 Claims, 8 Drawing Sheets

U.S. PATENT DOCUMENTS

| | | | | |
|---|---|---|---|---|
| 2004/0164268 | A1* | 8/2004 | Obara et al. | 251/368 |
| 2004/0166006 | A1* | 8/2004 | Bergman et al. | 417/567 |
| 2005/0047928 | A1 | 3/2005 | Koelzer et al. | |
| 2005/0074351 | A1* | 4/2005 | Kultgen | 417/569 |
| 2005/0112002 | A1* | 5/2005 | Leu | 417/419 |
| 2006/0177331 | A1* | 8/2006 | Bergman et al. | 417/569 |
| 2009/0050635 | A1* | 2/2009 | Richards et al. | 220/584 |

FOREIGN PATENT DOCUMENTS

| | | | |
|---|---|---|---|
| DE | 2545279 | A1 | 4/1977 |
| DE | 4131886 | A1 | 4/1993 |
| JP | 59208181 | A | 11/1984 |
| JP | 63076746 | A | 4/1988 |
| JP | 08284815 | | 10/1996 |
| JP | 2005090496 | | 4/2005 |

OTHER PUBLICATIONS

International Search Report regarding International Application No. PCT/US2008/011400 dated Feb. 4, 2009.

Supplementary European Search Report regarding Application No. 08835757.9-2315, dated Jun. 9, 2011.

Extended European Search Report regarding Application No. 11162102.5-2315, dated Jun. 9, 2011.

* cited by examiner

COMPRESSOR HAVING IMPROVED VALVE PLATE

CROSS-REFERENCE TO RELATED APPLICATIONS

This application claims the benefit of U.S. Provisional Application No. 60/976,873, filed on Oct. 2, 2007. The entire disclosure of the above application is incorporated herein by reference.

FIELD

The present disclosure relates to valve plate assemblies, and more specifically to compressor valve plate assemblies.

BACKGROUND

The statements in this section merely provide background information related to the present disclosure and may not constitute prior art.

Compressor valve plates are typically formed from a series of stamped parts coupled to one another. The valve plates usually include first and second plates with a series of spacers providing support between adjacent surfaces of the first and second plates. The use of stamped parts limits the geometry that the first and second plates may include. This results in the spacers being formed as separate parts, creating additional cost and increased complexity in assembly.

SUMMARY

A compressor may include a compressor body defining a compression cylinder, a compressor head coupled to the compressor body, and a valve plate assembly disposed between the compressor head and the compressor body. The valve plate assembly may include a first valve plate formed as a unitary casting and defining a suction chamber exposed to a suction pressure region of the compressor.

The first valve plate may define a discharge passage. The first valve plate may additionally include a central recessed portion surrounded by an outer wall integrally formed therewith and extending a height above the central recessed portion. The discharge passage may pass through the central recessed portion.

The first valve plate may include a central recessed portion defining the suction chamber and being surrounded by an outer wall integrally formed therewith and extending a height above the central recessed portion. The compressor may additionally include a second valve plate having an outer perimeter portion abutting the outer wall of the first valve plate. The suction chamber may be defined between the first and second valve plates and the second valve plate may include an inlet port in communication with the suction chamber. The second valve plate may include an outlet port in communication with the suction chamber. The first valve plate may include a support member integrally formed with and extending from the central recessed portion and engaged with the second valve plate. The support member may include a rib extending therefrom. The first and second valve plates may be brazed together. The second valve plate may be formed from a stamping process. The second valve plate may include a circumferentially outer surface mechanically engaged with a circumferentially inner surface of the outer wall of the first valve plate.

The first valve plate may be made from steel.

The valve plate assembly may consist of a single cast valve plate. The single cast valve plate may be formed by a lost foam casting process. The lost foam casting process may include a mold formed from Mullite sand. The single cast valve plate may include an as-cast reed valve relief therein. The single cast valve plate may be made from steel. The single cast valve plate may include a sand clean out passage that facilitates removal of sand from internal passages of the single cast valve plate.

Alternatively, a compressor may include a compressor body defining a compression cylinder, a compressor head coupled to the compressor body, and a valve plate assembly disposed between the compressor head and the compressor body and including first and second valve plates. The first valve plate may be formed of a unitary casting and may include an integrally formed outer wall defining a recessed portion. The second valve plate may be fixed to the outer wall and may define a suction chamber between the first and second valve plates within the outer wall. The suction chamber may be exposed to a suction pressure region of the compressor.

The outer wall may extend around an outer perimeter of the first valve plate. The first valve plate may include a support member integrally formed with and extending from the recessed portion and engaged with the second valve plate. The second valve plate may be formed from a stamping process.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
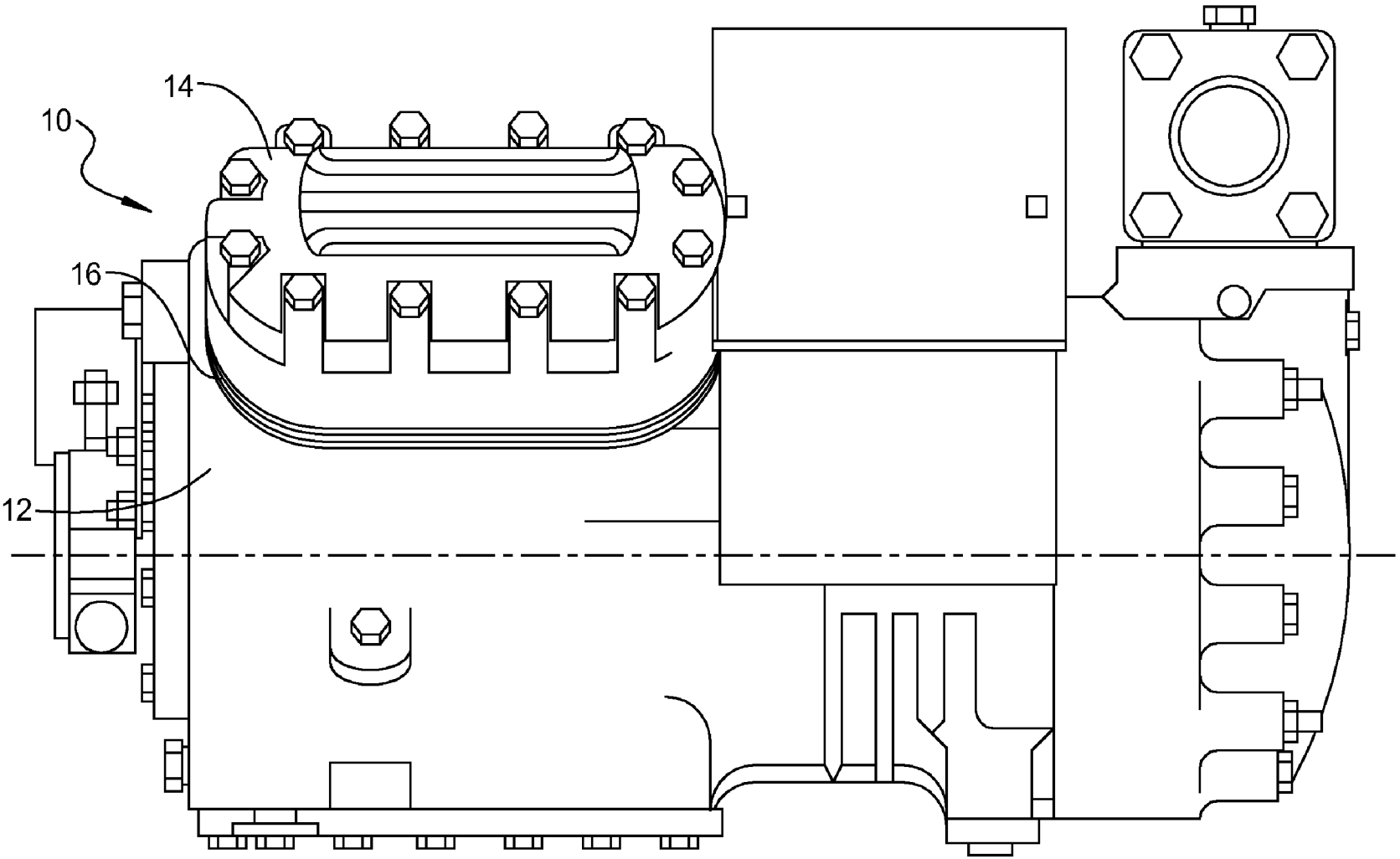
FIG. 1 is a perspective view of a rotary compressor according to the present disclosure.
Figure 2:
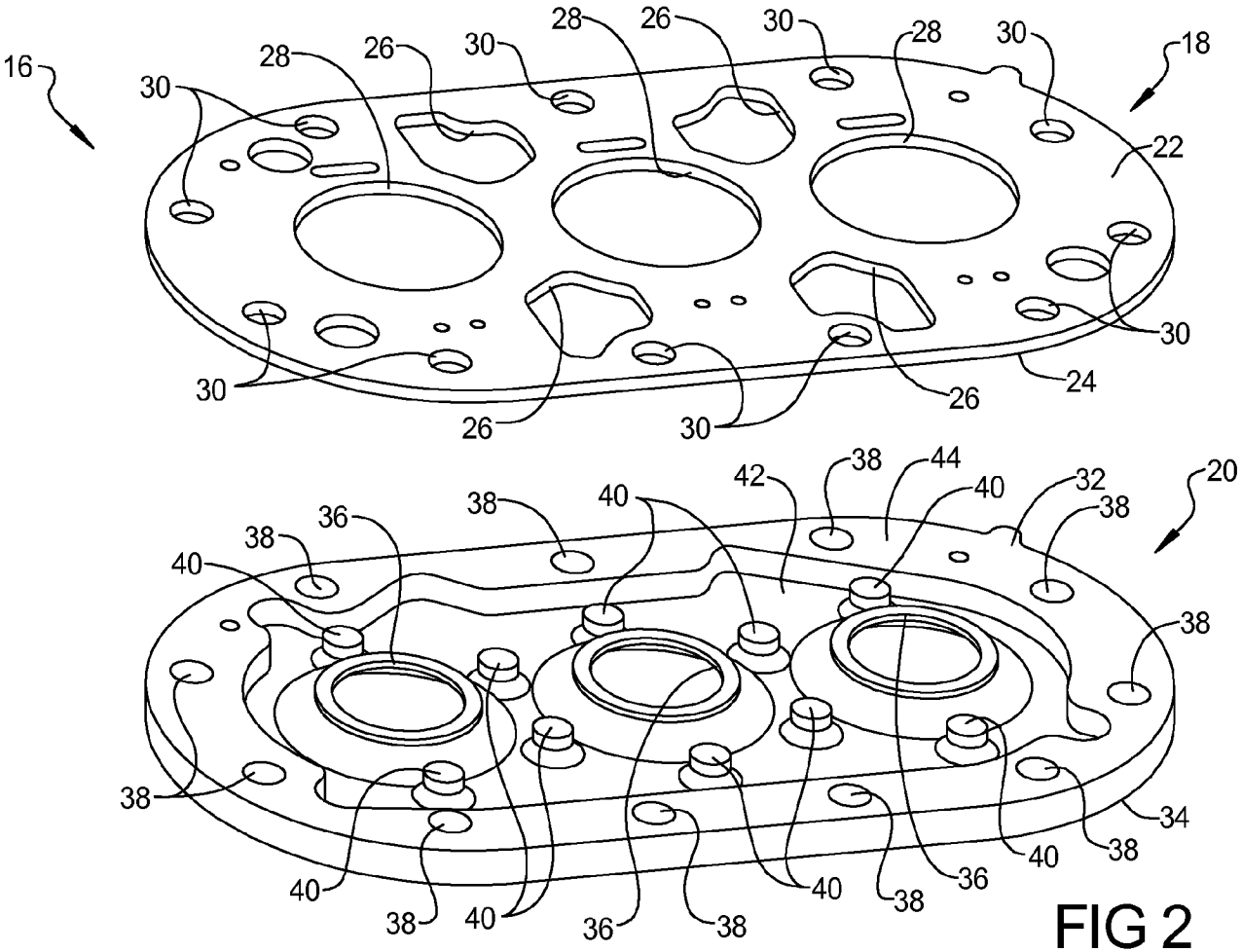
FIG. 2 is a perspective exploded view of a first valve plate assembly.
Figure 3:
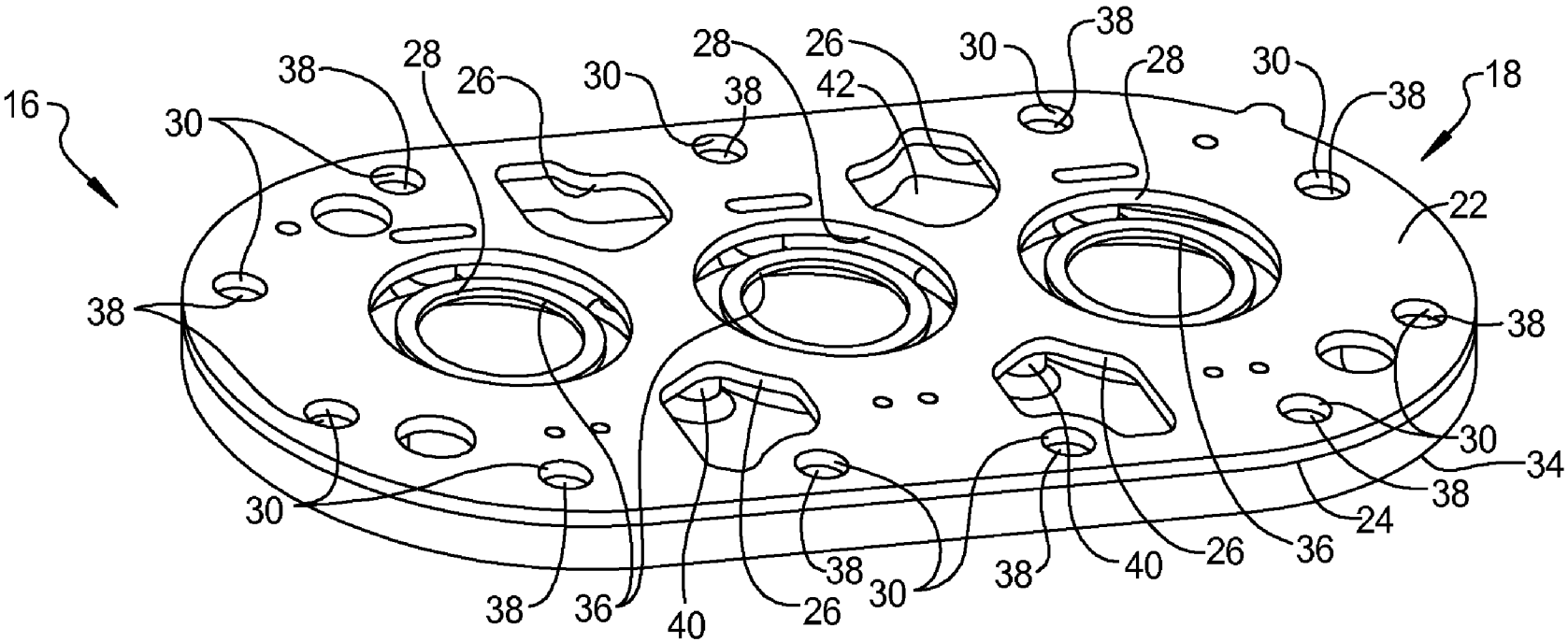
FIG. 3 is a perspective view of the first valve plate assembly of FIG. 2.

The following description is merely exemplary in nature and is not intended to limit the present disclosure, application, or uses. It should be understood that throughout the drawings, corresponding reference numerals indicate like or corresponding parts and features.

Figure 8:
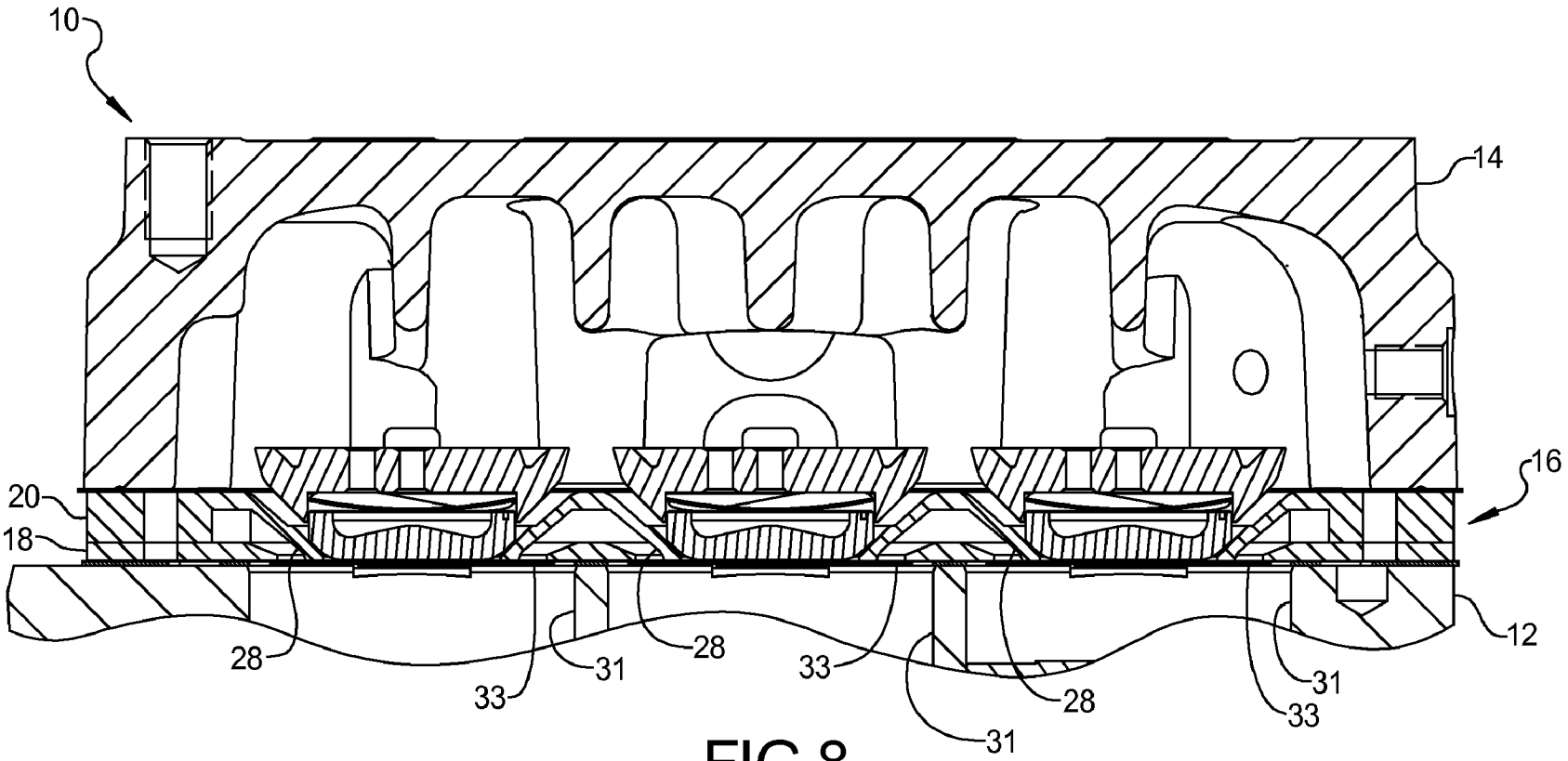
FIG. 8 is a fragmentary section view of the compressor of FIG. 1 including the valve plate assembly of FIG. 2.

With reference to FIGS. 1 and 8, a compressor assembly 10 is shown and may generally be a reciprocating piston-type compressor. Compressor assembly 10 may include a compressor body 12, a compressor head 14, and a valve plate assembly 16 disposed therebetween. With reference to FIGS.

2 and 3, valve plate assembly 16 may include first and second valve plates 18, 20 brazed together.

First valve plate 18 may include generally planar first and second surfaces 22, 24 having a series of suction inlet passages 26, suction outlet passages 28, and bolt holes 30 passing therethrough. As seen in FIG. 8, suction outlet passages 28 may selectively be in fluid communication with cylinders 31 of compressor assembly 10 through actuation of valves 33, such as reed valves. Outlet passages 28 may form suction inlets for cylinders 31.

Second valve plate 20 may include first and second surfaces 32, 34 having discharge passages 36 and bolt holes 38 extending therethrough and spacers 40 extending therefrom. First surface 32 may include a recessed central portion 42 having a wall 44 extending therearound. Central recessed portion 42 may generally define a suction chamber within valve plate assembly 16. The suction chamber may be in fluid communication with the inlet and outlet passages 26, 28. First valve plate 18 may be formed from a stamping process and may be made of steel. Second valve plate 20 may be formed by investment casting and may also be made from steel.

A casting mold may be made for second valve plate 20. The mold may be made for either a solid investment process or a ceramic shell process. In either form, as second valve plate 20 is a cast part, each of the features discussed above that are associated with second valve plate 20 may be integrally formed with the entire second valve plate 20. This may eliminate the need for multiple loose parts during assembly. Use of an investment casting may also provide for use of a higher carbon steel and improved heat treatment process relative to the currently used stampings.

More specifically, use of investment castings may provide a greater control of chemistry variation of parts, providing a lower cycle time for a carburizing process. Steel used in conventional stampings may be provided from commercial steel mills. The steel provided by the commercial steel mills may include a range of chemistry variation that is significantly greater than the chemistry variation of the investment casting. This increased chemistry variation may result in use of a carburizing process with increased cycle times relative to cycle times associated with cast parts to ensure adequate hardness.

Figure 4:
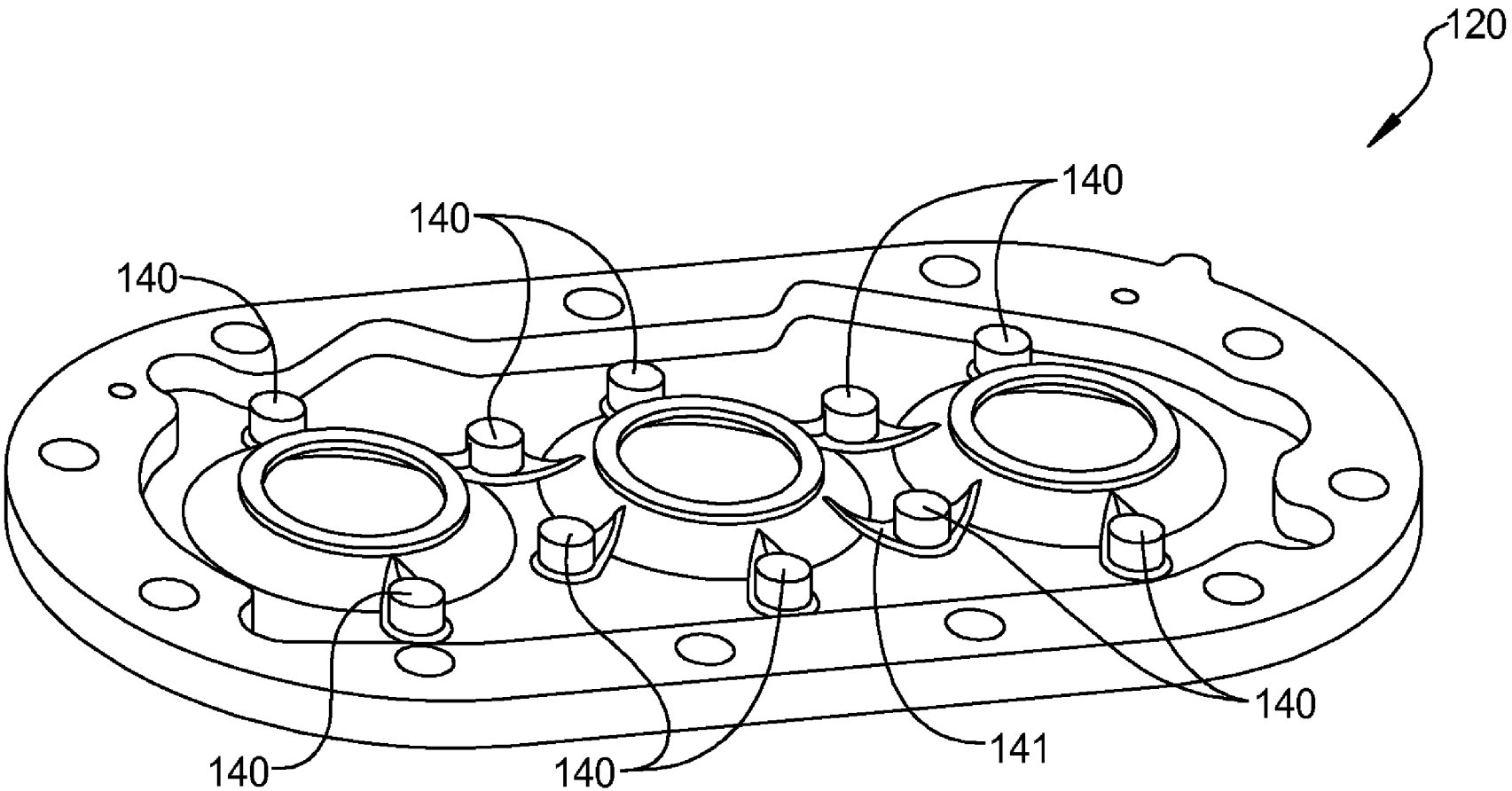
FIG. 4 is a perspective view of an alternate valve plate of the first valve plate assembly of FIG. 2.

With reference to FIG. 4, an alternate second valve plate 120 is shown. Second valve plate 120 may be generally similar to second valve plate 20, with the exception of spacers 140. Spacers 140 may include ribs 141 to increase the strength thereof relative to the non-ribbed spacers 40 of second valve plate 20. The use of an investment casting process may generally provide for forming ribs 141, as this type of geometry may not be formed using conventional stampings.

Figure 5:
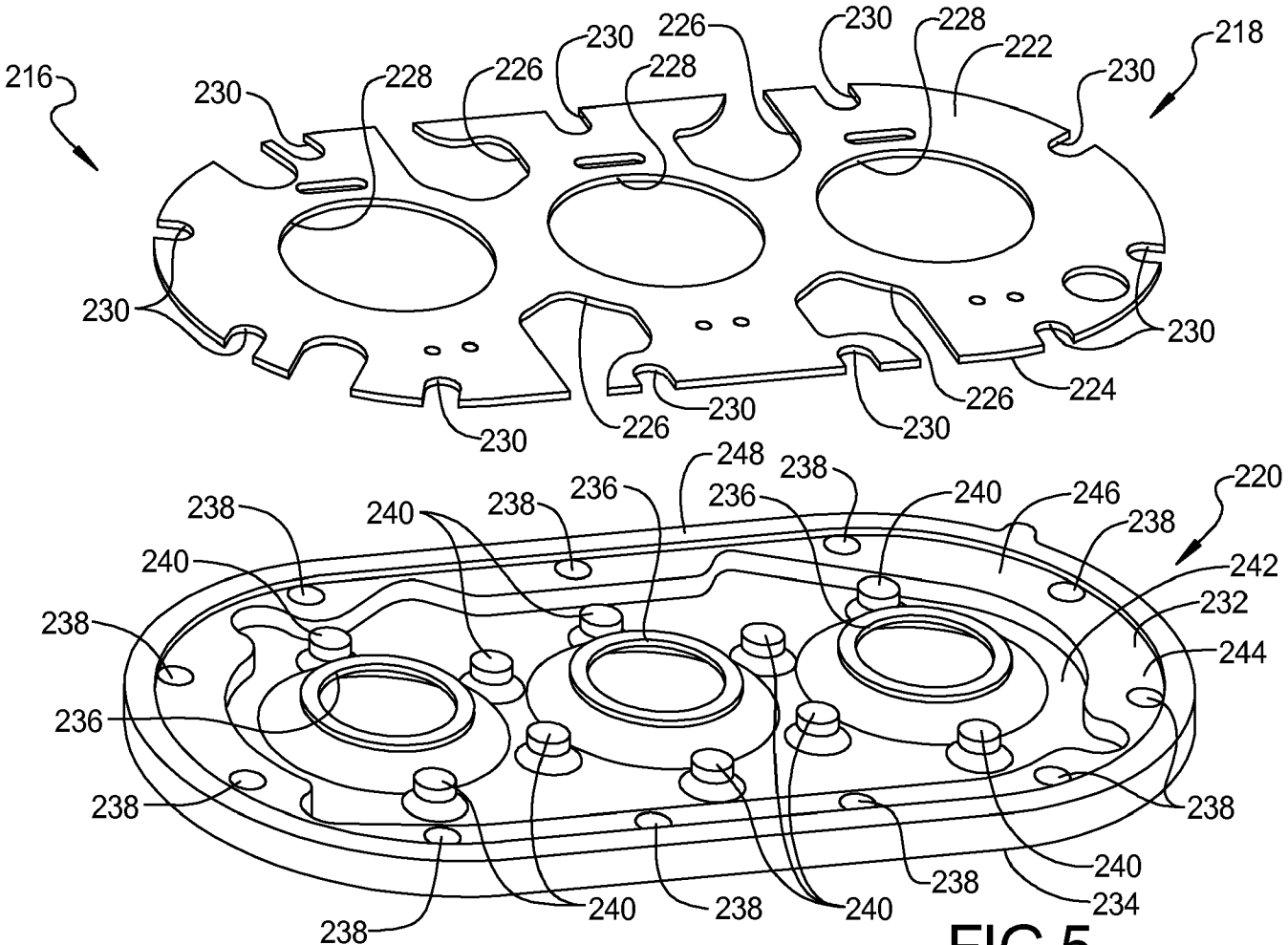
FIG. 5 is a perspective exploded view of a second valve plate assembly.
Figure 6:
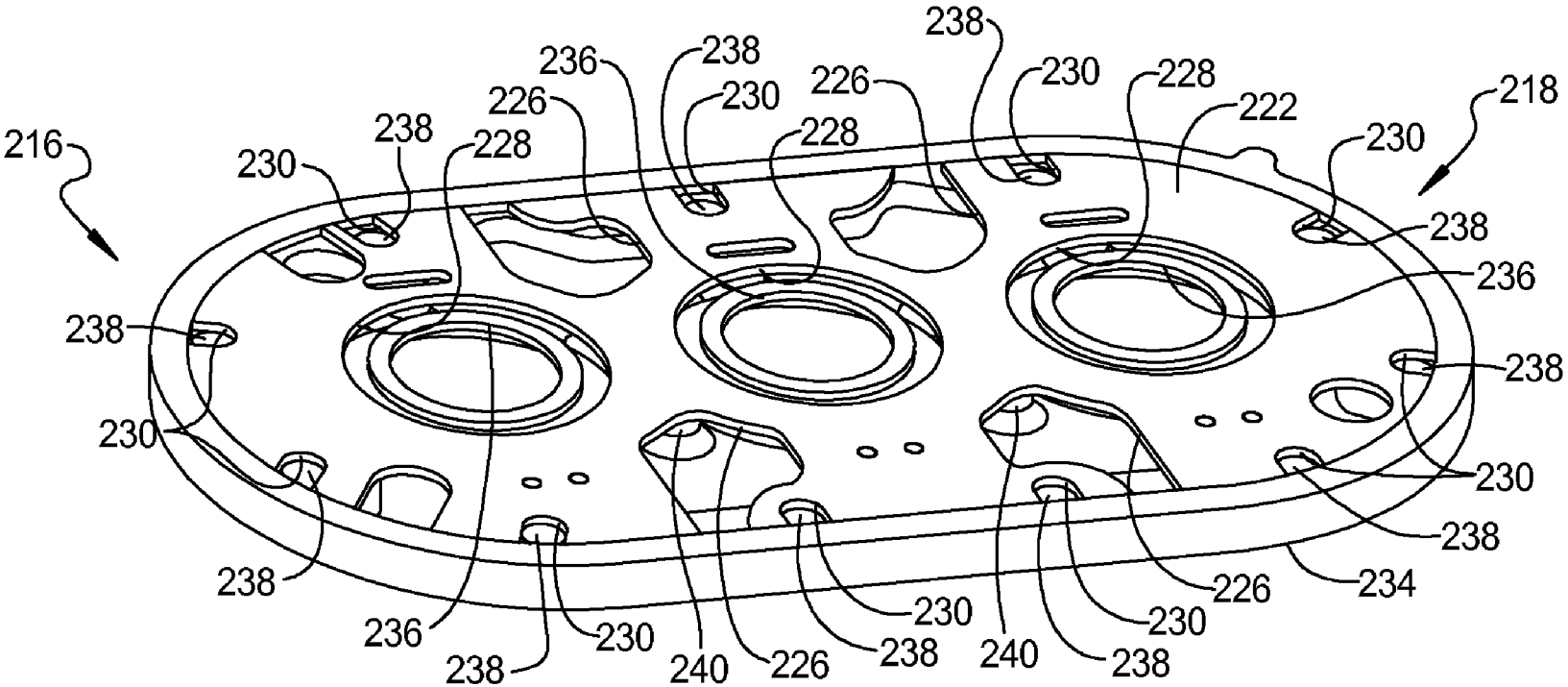
FIG. 6 is a perspective view of the second valve plate assembly of FIG. 5.

With reference to FIGS. 5 and 6, an alternate valve plate assembly 216 may include first and second valve plates 218, 220. First valve plate 218 may include generally planar first and second surfaces 222, 224 having a series of suction inlet passages 226, suction outlet passages 228, and bolt holes 230 passing therethrough. Second valve plate 220 may include first and second surfaces 232, 234 having discharge passages 236 and bolt holes 238 extending therethrough and spacers 240 extending therefrom. It is understood that spacers 240 may also include ribs (not shown) as discussed above. First surface 232 may include a recessed central portion 242 having a wall 244 extending therearound. Wall 244 may include first and second portions 246, 248. Second portion 248 may be disposed radially outwardly of first portion 246 and may extend axially outwardly therefrom a distance generally equal to the thickness of first valve plate 218. First valve plate 218 may be formed from a stamping process and may be made of steel. Second valve plate 220 may be formed by investment casting and may also be made from steel, similar to second valve plate 20.

However, rather than being brazed to one another, first and second valve plates 218, 220 may be connected through an interference fit engagement. More specifically, first valve plate 218 may have a length that is greater than the distance between opposite portions of second portion 248 of wall 244 and may be forced into engagement with second portion 248 of wall 244 of second valve plate 220. First valve plate 218 may therefore be mechanically secured to second valve plate 220. The mechanical, or interference fit, engagement between first and second valve plates 218, 220 may provide for the use of localized heat treatment options that may not be available with a brazed engagement.

More specifically, rather than using a batch or oven-type heat treatment process associated with a brazed engagement, an individual localized heat treatment process may be used. The individual heat treatment process may be a laser or induction heat treatment process and may be applied to valve plate 220 at a region around discharge passages 236.

Figure 7:
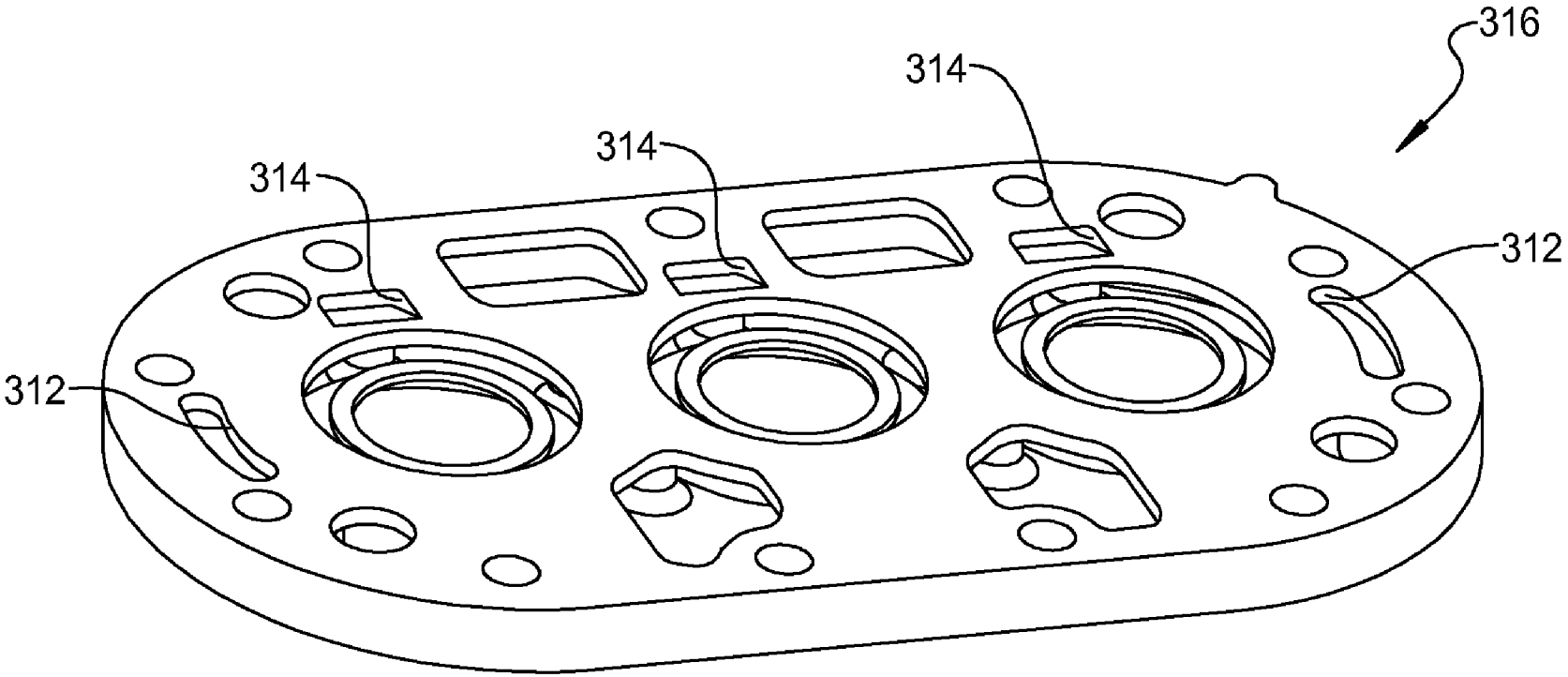
FIG. 7 is a perspective view of a third valve plate assembly.

With reference to FIG. 7, an alternate valve plate 316 may be formed as a single piece. More specifically, valve plate 316 may be formed from a lost foam casting process. Valve plate 316 may be generally similar to valve plate assemblies 16, 216, but may be formed from a single piece, rather than first and second valve plates. As such, the description of material properties and heat treatment options above applies equally to valve plate 316. The lost foam casting process used to form valve plate 316 may utilize steel as the casting material.

The use of the lost foam casting process may generally provide for easier design modifications relative to stamping or investment casting processes, since the sacrificial foam part is primarily the portion of the process that is altered for design modifications. Intricate passages, such as those found in valve plate 316, may typically provide difficulty in removal of the sand typically used in the casting process. However, valve plate 316 may be cast using Mullite sand ($Al_{4.5}Si_{1.5}O_{9.5}$). Use of Mullite sand for the mold of valve plate 316 may generally provide for easier clean-out of valve plate 316 relative to traditional silica sands.

In order to further facilitate sand clean-out after casting of valve plate 316, several clean-out passages 312 may be cast into valve plate 316. Additionally, as a result of the use of the lost foam casting process to form valve plate 316, additional machining operations that may typically be required for stamping or investment casting processes may be eliminated. For example, reed valve relief 314 may be formed as-cast in valve plate 316.

What is claimed is:

1. A compressor comprising:

a compressor body defining a compression cylinder;

a compressor head coupled to said compressor body; and a valve plate assembly including a first valve plate and a second valve plate, said first valve plate formed of a unitary casting and disposed between said compressor head and said compressor body, said first valve plate defining a suction chamber exposed to a suction pressure region of the compressor and including a central recessed portion defining said suction chamber and surrounded by an outer wall integrally formed therewith and extending a height above said central recessed portion, said second valve plate including a circumferentially outer surface mechanically engaged with a circumferentially inner surface of said outer wall of said first valve plate and including an inlet port in communication with said suction chamber, and said suction chamber being defined between said first and second valve plates.

2. The compressor of claim 1, wherein said first valve plate defines a discharge passage therethrough.

3. The compressor of claim 2, wherein said discharge passage passes through said central recessed portion.

4. The compressor of claim 1, wherein said second valve plate includes an outlet port in communication with said suction chamber.

5. The compressor of claim 1, wherein said first valve plate includes a support member integrally formed with and extending from said central recessed portion and engaged with said second valve plate.

6. The compressor of claim 5, wherein said support member includes a rib extending therefrom.

7. The compressor of claim 1, wherein said second valve plate is formed from a stamping process.

8. The compressor of claim 1, wherein said first valve plate is made from a steel.

9. A compressor comprising:

a compressor body defining a compression cylinder;

a compressor head coupled to said compressor body; and a valve plate assembly consisting of a single cast valve plate formed of a unitary casting and disposed between said compressor head and said compressor body, said valve plate including first and second plate regions spaced from one another by an annular wall defining a suction chamber exposed to a suction pressure region of the compressor and including a sand clean out passage defined in said first plate region that facilitates removal of sand from internal passages of said valve plate.

10. The compressor of claim 9, wherein said single cast valve plate is formed by a lost foam casting process.

11. The compressor of claim 10, wherein said lost foam casting process includes a mold formed from Mullite sand.

12. The compressor of claim 9, wherein said single cast valve plate includes an as-cast reed valve relief therein.

13. The compressor of claim 9, wherein said single cast valve plate is made from a steel.

* * * * *